US009392926B2

(12) United States Patent
Zardini

(10) Patent No.: US 9,392,926 B2
(45) Date of Patent: Jul. 19, 2016

(54) WASHING ROTOR AND WASHER MACHINE COMPRISING SAID WASHING ROTOR

(75) Inventor: Fabio Zardini, Castelfranco Veneto (IT)

(73) Assignee: STEELCO SPA, Riese Pio X (IT)

( * ) Notice: Subject to any disclaimer, the term of this patent is extended or adjusted under 35 U.S.C. 154(b) by 715 days.

(21) Appl. No.: 13/702,630

(22) PCT Filed: Jun. 9, 2011

(86) PCT No.: PCT/IB2011/001274
§ 371 (c)(1),
(2), (4) Date: Jan. 14, 2013

(87) PCT Pub. No.: WO2011/154813
PCT Pub. Date: Dec. 15, 2011

(65) Prior Publication Data

US 2013/0112230 A1 May 9, 2013

(30) Foreign Application Priority Data

Jun. 10, 2010 (IT) ..... UD2010A0114

(51) Int. Cl.
*A47L 15/18* (2006.01)
*A47L 15/22* (2006.01)
*A47L 15/23* (2006.01)

(52) U.S. Cl.
CPC ..... *A47L 15/23* (2013.01); *A47L 15/18* (2013.01); *A47L 15/22* (2013.01)

(58) Field of Classification Search
CPC ..... A47L 15/18; A47L 15/22; A47L 15/23
USPC ..... 134/56 D, 57 D, 58 D, 198
See application file for complete search history.

(56) References Cited

U.S. PATENT DOCUMENTS 2,286,203 A 6/1942 Fox
2,637,595 A 5/1953 Fox et al.
4,145,002 A 3/1979 Noren
4,884,585 A 12/1989 Oh

OTHER PUBLICATIONS

International Search Report filed in PCT/IB2011/0001274.

*Primary Examiner* — Michael Barr
*Assistant Examiner* — Levon J Shahinian
(74) *Attorney, Agent, or Firm* — Rankin, Hill & Clark LLP

(57) ABSTRACT

Washing rotor (10) for a washer machine such as a dishwasher or a machine for washing objects, comprising at least an oblong body (12) having a mainly longitudinal direction of development (X) and having two opposite ends (13). The oblong body (12) has an internal cavity which develops from one to the other of said opposite ends (13), so that a washing fluid can pass, wherein at least one end (13) has a service aperture (17) for access into said internal cavity. The washing rotor (10) comprises a closing member (14) for the selective closing of said service aperture (17). The closing member (14) is formed by at least two elements (18, 30), of which a first attachment element (18) is removably attached to the corresponding end (13) by means of attachment means, and a second closing element (30) is constrained to the first element (18) and is movable with respect thereto between a first position, or closed position, in which it cooperates with the first element (18) in order to close the service aperture (17), and a second position, or open position, in which it allows access through the service aperture (17).

11 Claims, 3 Drawing Sheets

WASHING ROTOR AND WASHER MACHINE COMPRISING SAID WASHING ROTOR

FIELD OF THE INVENTION

The present invention concerns a washing rotor for a washer machine such as a dishwasher or a machine to wash objects which can be used in public places such as bars restaurants, hospitals, surgeries or other, for washing, rinsing and sanitizing dishes, cutlery, pans, hospital instruments or other objects or tools substantially of any type.

In particular, the washing rotor according to the present invention is provided with a closing member disposed at its ends in order to carry out periodic cleaning operations inside it.

BACKGROUND OF THE INVENTION

Washing rotors are known, for washer machines such as dishwashers or machines for washing objects which can be used in public places such as bars, restaurants, hospitals, surgeries, communities or other. Known washer machines have an internal washing chamber in which one or more of the washing rotors are disposed. Known rotors have an oblong tubular shape, rotatably connected, in correspondence with a median portion, to a hydraulic feed circuit. Known rotors also have holes made above and/or below along their longitudinal development, in order to determine the delivery of water or other washing liquid inside the washing chamber, or alternatively they may be equipped with delivery nozzles, shaped or added and made of plastic.

At least part of the holes or nozzles are inclined and there are one or more nozzles at the end of the rotor, which are also inclined, so that the delivery of the water under pressure through these not only allows to wash the objects in the washing chamber, but also produces a thrust force which determines the rotation of the rotor.

Each of the ends of known rotors is also provided with a closing member, attached to it by attachment means, such as one or more screws, and which can be completely detached from the rotor in order to allow access to its internal cavity in order to carry out periodic maintenance operations, such as cleaning, sanitization and/or removing possible solid residues which can be deposited on the internal walls over time.

One disadvantage of known rotors is that, especially in the case of frequent maintenance operations, such as for example in the case where the washer machine is used in hospital environments, the separation of each closing member from the relative end of the washer rotor and the subsequent assembly at the end of maintenance require rather long intervention times. Indeed this operation entails the removal of the attachment means which maintain the closing member coupled to the rotor during use, or may even entail the removal of the rotor itself, in the case where the seating where the attachment means are inserted is not easily accessible. This, in its turn, entails an increase in maintenance costs and extended down-times of the machine, with consequent decrease in productivity.

Document U.S. Pat. No. 4,145,002 describes a rotor for a washer machine which comprises closing members at the ends in order to close the service apertures which allow access to the inside of the rotor for cleaning. Each closing member comprises a frame solidly constrained to the end so it cannot be removed, and able to swing from a closed position to an open position. Moreover, each closing member comprises a removable cleaning hood, assembled on the frame in an adjustable way by means of screwing, so as to be moved selectively nearer to/away from the service aperture, when the frame is in the closed position. This solution has the disadvantage of being somewhat complex, laborious and not easy to use.

One purpose of the present invention is to achieve a washing rotor for a washer machine such as a dishwasher or a machine for washing objects which allows to carry out rapid and easy operations for the cleaning, sanitization and/or maintenance of its internal cavity, reducing the relative costs of maintenance and increasing productivity.

A further purpose of the present invention is to achieve a washing rotor whose closing member or members allows/allow to carry out cleaning interventions remaining stable in its place in any working condition.

Another purpose of the present invention is to allow maintenance interventions of the terminal ends and/or of the closing member or members.

It is also a purpose of the present invention to achieve a closing member for a washing rotor which is solid and stable over time.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

A washing rotor for a washer machine, such as a dishwasher or a machine for washing objects according to the present invention, comprises in a known way at least an oblong body having a mainly longitudinal direction of development and with two opposite ends.

The oblong body has an internal cavity which develops from one to the other of the opposite ends, for the passage of a washing fluid from a common entrance toward a plurality of holes made along the surface of the oblong body, which act as delivery nozzles for the washing fluid. Moreover, at least one of the ends has a service aperture of such sizes that through it an operator or user can access the internal cavity, with suitable instruments or manually, for example for maintenance, cleaning or sanitizing operations. A closing member is provided in order to close the service aperture.

According to the present invention, the closing member is formed by at least two elements, of which a first attachment element is removably attached to the at least one end by means of attachment means, such as one or more screws. The closing member is formed by a second closing element, which is constrained to the first attachment element and is mobile with respect to it between a first position, or closed position, in which it cooperates with the first attachment element to close the service aperture and a second position, or open position, in which it allows access through the service aperture.

Therefore the washing rotor according to the invention allows to carry out maintenance operations such as for example cleaning, maintenance and/or sanitization of the internal cavity, without needing to remove the closing member from the relative ends, but simply by opening/closing the closing element. This allows to make the ordinary maintenance operations quicker and easier, since no specific instruments or tools are needed to open or remove the closing member, and to considerably reduce costs and down-times of the machine.

According to the present invention, the closing member comprises first and second hinging means associated both to the attachment element and to the closing element by means of which the first attachment element is hinged to the second closing element. This allows to determine a rotation of the first closing element with respect to the second attachment element in order to pass from the first closed position to the second open position. Therefore the opening and closing of the internal cavity occur, in an easy and intuitive way, by making the second closing element rotate manually with respect to the first attachment element.

According to a variant of the present invention, the rotor comprises first clamping means able to keep the closing element stably clamped in its first position.

In one form of embodiment, the first clamping means are attached to the first attachment element and cooperate mechanically and elastically with the attachment element.

In another form of embodiment, the first clamping means are attached to the first attachment element and cooperate mechanically and elastically with the closing element.

According to a variant of the present invention, the rotor comprises a magnetic element able to cooperate, during use, with a magnetic sensor disposed in a fixed position, in order to detect the speed of rotation of the washing rotor. The magnetic element is stably disposed in a housing of the closing member.

According to a further variant, the housing is made in the first attachment element and faces toward the cavity of the tubular oblong body so as to be accessible when the second closing element is in the second open position.

According to a further variant, the washing rotor comprises second clamping means able to stably hold the magnetic element in the housing seating.

According to a variant, in the first attachment element or in the second closing element there is at least one delivery nozzle, angled and suitable to deliver the washing fluid in a direction concordant to the longitudinal development direction or at an angle as desired, with respect both to a horizontal plane and/or to a vertical plane.

The present invention also concerns a washer machine comprising a washing rotor as described above.

Moreover, the present invention also concerns a closing member which can be applied to at least one end of a washing rotor of a washer machine, in particular a dishwasher or a machine for washing objects, for the selective closing of a service aperture of the at least one end through which to access an internal cavity of the washing rotor.

The closing member comprises a first attachment element configured to be stably constrained to at least the end by means of attachment means. According to the present invention the closing member comprises a second closing element, stably connected to the first attachment element and mobile with respect thereto between a first position, in which it cooperates with the first element in order to close the service aperture of the corresponding end, and a second position, or open position, in which it allows access through the service aperture.

BRIEF DESCRIPTION OF THE DRAWINGS

These and other characteristics of the present invention will become apparent from the following description of a preferential form of embodiment, given as a non-restrictive example with reference to the attached drawings wherein.

To facilitate comprehension, identical reference numbers have been used, where possible, to identify identical common elements in the drawings.

DETAILED DESCRIPTION OF A PREFERENTIAL FORM OF EMBODIMENT

Figure 1:
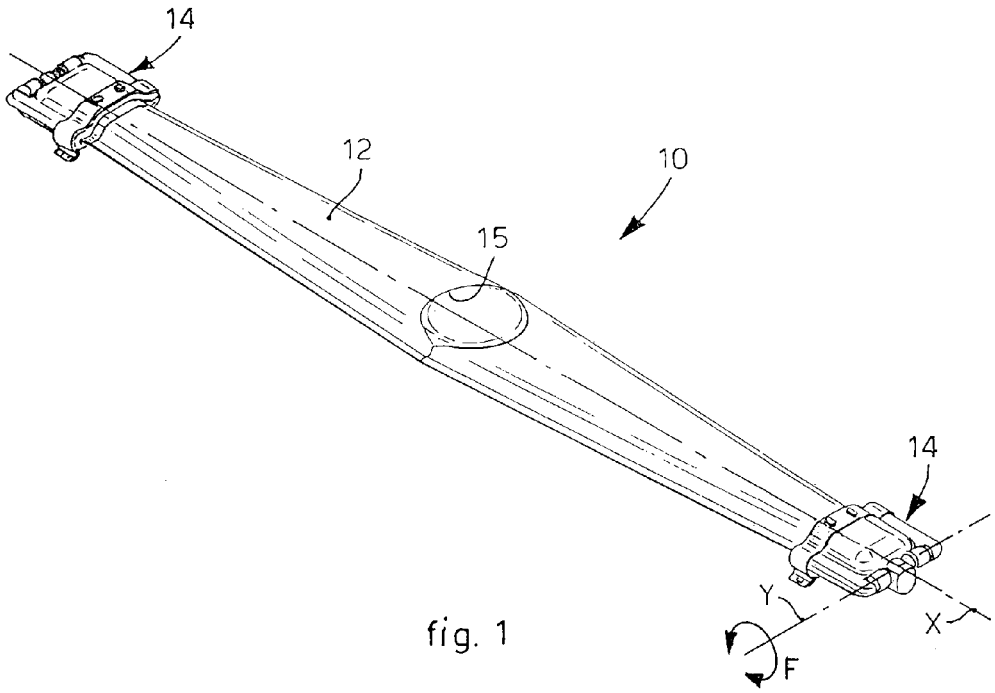
FIG. 1 is a three-dimensional view of a washing rotor according to the present invention.
Figure 2:
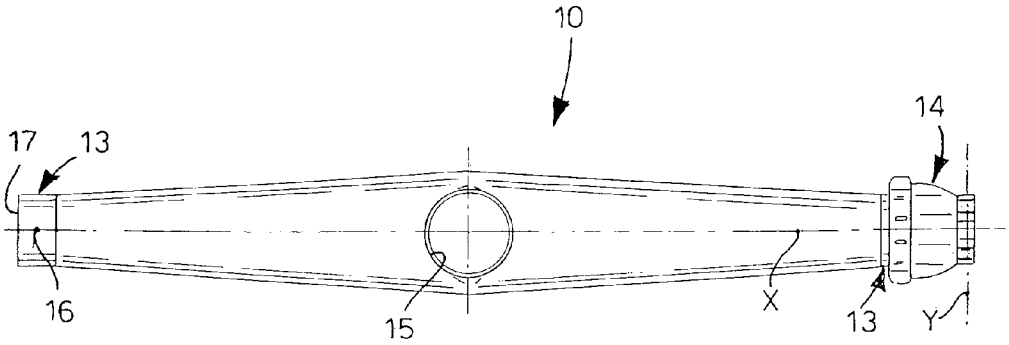
FIG. 2 is a view from above of the rotor in FIG. 1.

With reference to the attached drawings, a washing rotor 10 according to the present invention can be used in a washer machine such as a dishwasher or a machine for washing objects, not shown in the drawings. The rotor 10 comprises an oblong tubular body, normally made of aluminum, stainless steel, or plastic or other type of material which is resistant to water and humidity. The tubular body 12 extends according to a mainly longitudinal direction of development indicated with "X", between two opposite ends 13.

In a form of embodiment not shown, the rotor 10 comprises more than one tubular body 12. The washing rotor 10 can for example be provided with two tubular bodies 12 disposed reciprocally crossed, for example perpendicular, so as to define a better washing efficiency depending on the sizes of the washer machine.

The tubular body 12 has an internal cavity into which, through an entrance in a central position, washing water under pressure is introduced, coming from a suitable hydraulic feed circuit. In particular, in some forms of embodiment, the tubular body 12 also has a circular aperture 15 for the entrance of the washing water, made in the upper part of its central portion, in correspondence with which the rotor 10 is mechanically connected to an attachment element, not shown. The aperture 15 substantially has the function of putting the cavity of the rotor 10 into hydraulic contact with the hydraulic circuit of the washer machine and of coupling the rotor 10 rotatably to the attachment element in order to allow it to rotate around a rotation axis "Z".

In a known way, the tubular body 12 also has holes, not shown, made on its external surface, communicating with the internal chamber, for the emission of washing water from the rotor 10 into a relative washing chamber of the washer machine.

The tubular body 12 can be made by reciprocally coupling two oblong metal elements, made for example from a sheet or a metal plate. The metal elements are bent along all their length so as to present, in any of their cross sections, along the corresponding direction of development, a substantially "U"-shaped profile provided with terminal portions of reciprocal coupling.

In this case and in a non-restrictive example of the present invention, the tubular body 12 has a maximum width in correspondence to one of its central portions, not shown, and progressively narrows toward its ends 13.

The ends 13 have relative terminal service apertures 17, through which to access the internal cavity of the tubular body 12 for the purposes of maintenance, cleaning and/or sanitizing. A pair of closing members 14 are provided for the selective closing of the service apertures 17 of the respective ends 13.

Each service aperture 17 is in this case shaped with a profile like opposite Us.

Each closing member 14 is mounted in a stable manner on a corresponding end 13 of the tubular body 12, thus determining the selective closing of the service apertures 17 and therefore, the watertight closing of the internal cavity. The closing member 14 is made, for example, by molding a plastic material.

According to the present invention, the closing member 14 comprises an attachment element 18 and a closing element 30 configured to be mobile with respect to each other.

In some forms of embodiment, the attachment element is stably constrained to the end 13, while the closing element 30 is hinged to the attachment element 18.

In particular, the attachment element 18 is attached to the corresponding end 13 of the rotor 10 by means of attachment means and the closing element 30 is stably connected to the attachment element 18 so as to be able to rotate with respect thereto, as indicated by the arrow "F", around a rotation axis "Y", orthogonal to the axis of development "X" of the tubular body 12.

As seen in the attached drawings, the closing element 30 can rotate between a first position, or closed position, in which it cooperates with the attachment element 18 so as to close the service aperture 17 of the corresponding end 13 of the internal cavity, and a second position or open position in which, not interfering with the service aperture 17 of the internal cavity of the tubular body 12, it allows access to it for ordinary maintenance operations.

Figure 5:
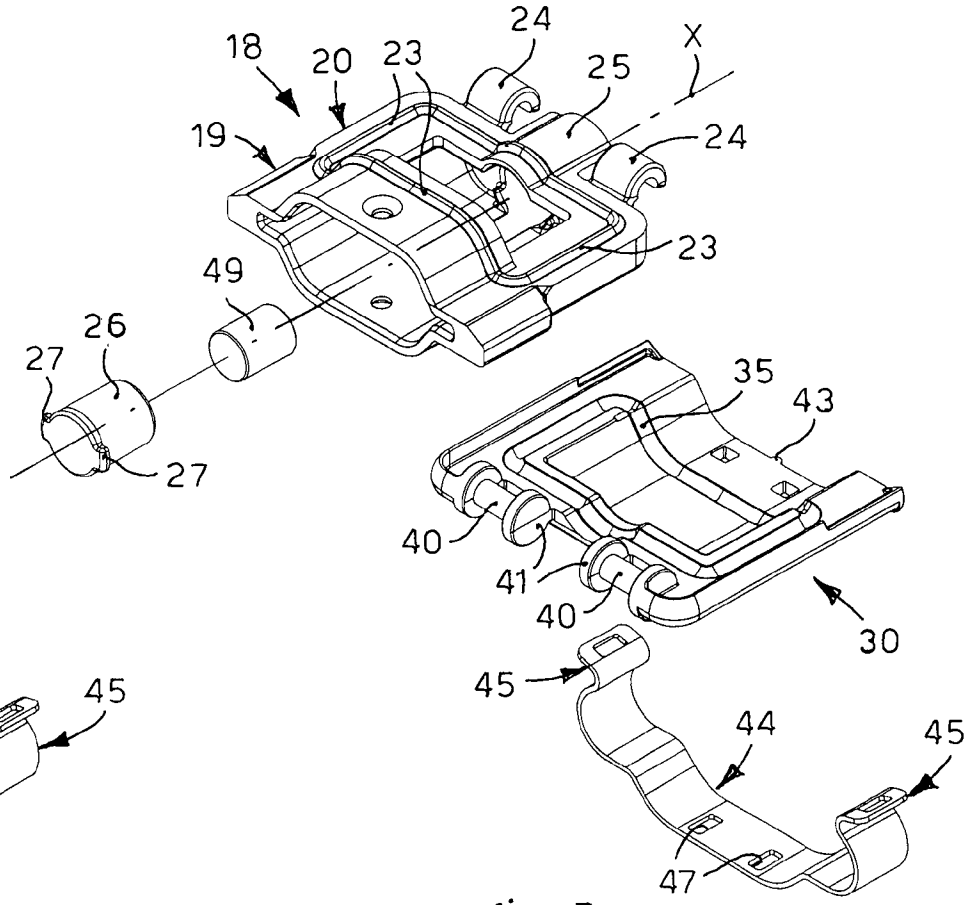
FIG. 5 is a three-dimensional view in separate parts of the closing member in FIGS. 3 and 4.
Figure 3:
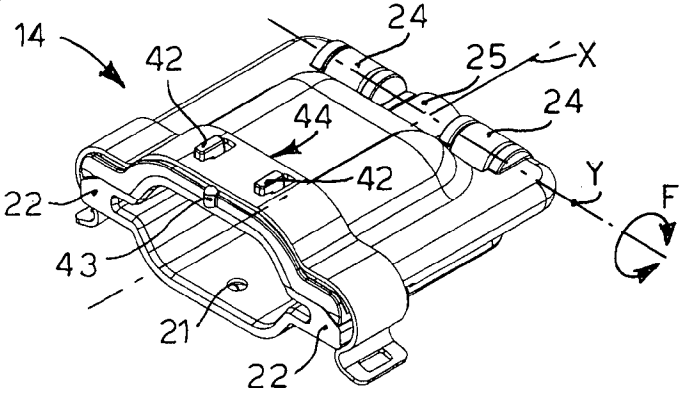
FIG. 3 is a three-dimensional view of a closing member of the washing rotor in a first operating configuration.
Figure 4:
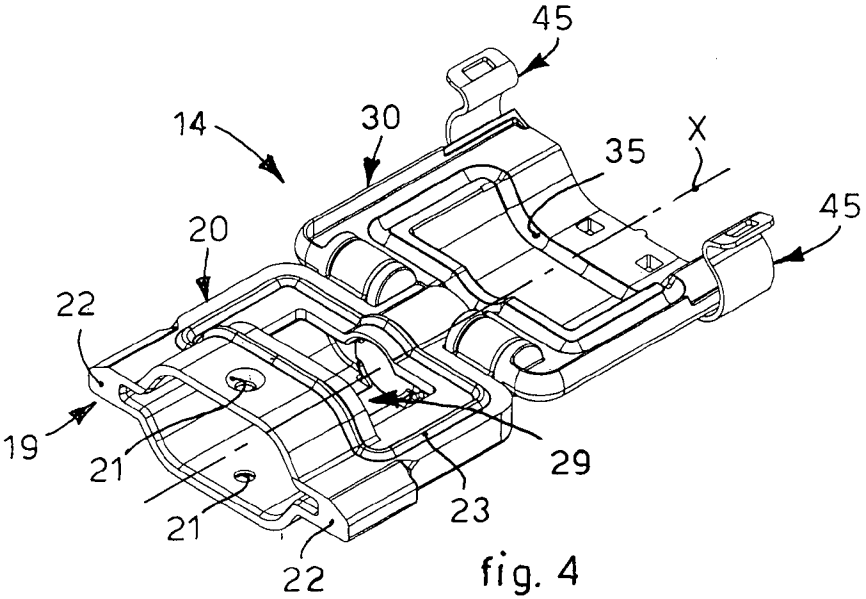
FIG. 4 is a three-dimensional view of the closing member of the washing rotor in a second operating configuration.

As shown in FIGS. 3-5, the attachment element 18 has a coupling portion 19 and a terminal portion 20, made in one piece. The coupling portion 19 develops longitudinally along the axis "X" for a determinate length so as to allow a stable coupling with the corresponding end 13.

Indeed, the coupling portion 19 is shaped according to a double "U" profile mating with the corresponding profile of the end 13 of the tubular body 12, so as to allow it to be axially inserted overlapping the end 13. The coupling portion 19 also has a pair of holes 21 made below and above, which have a flaring toward the inside for the insertion of an attachment screw or other attachment mean. The holes 21 are made reciprocally aligned so as to be aligned, in their turn, during use, with a corresponding pair of holes 16 made in the end 13 of the tubular body 12.

Therefore the holes 16 and 21 allow to attach, in a stable manner by means of a suitable attachment screw, the attachment element 18, and hence the closing member 14, to each corresponding end 13 of the rotor 10.

The coupling portion 19 also has protuberances 22, made laterally, which cooperate with a snap-in clamping plate 44, for example made of metal, in order to allow the stable maintenance of the closing element 30 with the attachment element 18.

The terminal portion 20 is open at the upper part and is shaped in a manner mating with the closing element 30, so as to make a reciprocal same-shape coupling which determines a sealed closing of the corresponding end 13.

The terminal portion 20 has a rib 23 which protrudes from its bulk in plane and develops perimetrically along the edges of the terminal portion 20. The rib 23 cooperates with a corresponding groove 35 of a mating shape of the closing element 30, when the latter is located in its first position. In this way, the coupling of the rib 23 and the groove 35 allows to obtain a hydraulic seal of the closing member 34.

Figure 6:
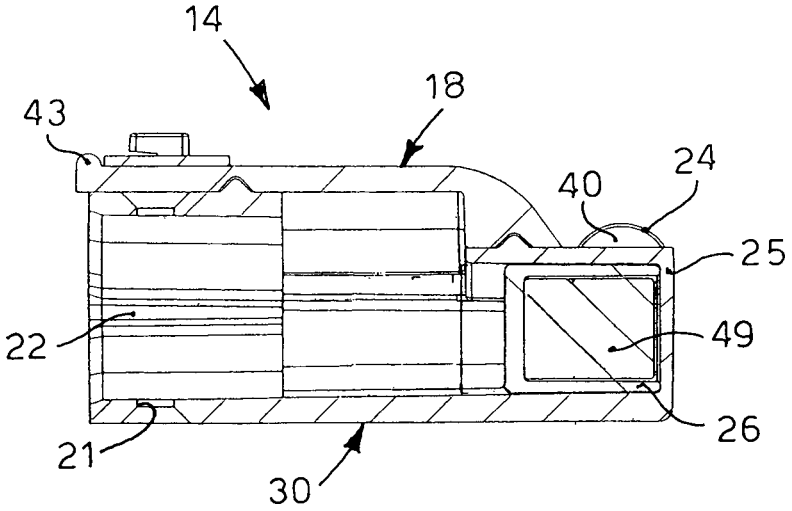
FIG. 6 is a section from VI to VI of FIG. 7.
Figure 7:
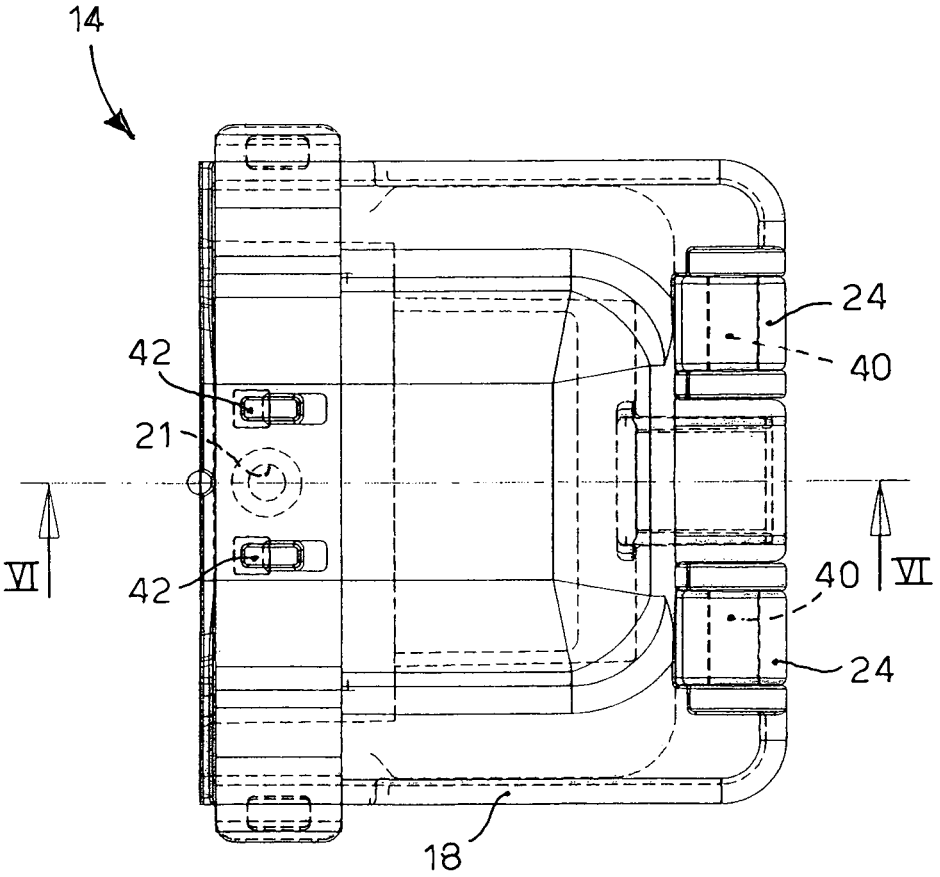
FIG. 7 is a plane view from above of the closing member in FIGS. 3 and 4.

The terminal portion 30 also comprises two articulation elements 24 made behind and outside the terminal portion 20 itself (FIGS. 5, 6 and 7). The articulation elements 24 have a semi-cylindrical shape and cooperate with corresponding rotation pins 40 of the closing element 30, to define hinging means that determine the rotation of the closing element 30 between the first open position and the second closed position.

The terminal portion 20 also has a cylindrical housing 25 hollow internally and made behind it, in a substantially central position, between the articulation elements 24.

The cylindrical housing 25 extends longitudinally in the direction of the axis X for a length substantially equal to the bulk in depth of the articulation elements 24.

The cylindrical housing 25 is of a suitable shape and size to house a magnet 49 of a mating shape which can be inserted inside it (FIGS. 5 and 6). The magnet 49 is used to allow the detection, by means of a corresponding sensor mounted in a fixed position inside or outside the washing chamber, of the rotation speed of the rotor 10.

A stopping element 26 is provided, of a shape suitable to close the cylindrical housing 25 and impede the contact of water with the magnet 49. The stopping element 26 has a cylindrical shape and is hollow internally, open in correspondence with a first base so that it can be fitted on the magnet 49, and closed, or blind, in correspondence with an opposite second base, which faces, when in use, toward the cavity of the tubular body 12.

The diameter and the height of the stopping element 26 are mating with the internal diameter and depth of the cylindrical housing 25, so as to allow it to be axially inserted through interference and thus to prevented from undesiredly coming out of the seating 25. The stopping element 26 also has tongues 27 made in diametrically opposite positions in correspondence to the closed base. The tongues 27 allow the clamping element 26 to be gripped and then removed from the seating 25 in order to remove and/or substitute the magnet 49.

The closing element 30, which also functions as a cover, has a shape substantially mating with the attachment element 18 so as to achieve with it a sealed closing of the end 13. In particular, with reference to FIGS. 4 and 5, the closing element 30 is shaped according to a profile, in a cross section with respect to the axis "X", of the "U" type mating with that of the tubular body 12 and of the attachment element 18. In particular, the groove 35 is made on a concave surface of the closing element 30, facing during use toward the inside of the closing member 14 when the closing element 30 is in the closed position. The groove 35 has a perimeter development and a transverse profile mating with that of the rib 23 in order to achieve the sealed closing.

In some forms of embodiment, the rotation pins 40 are made in one piece and disposed behind the closing element 30. The articulation elements 24 are coupled with them in order to allow the rotation of the closing element 30 with respect to the attachment element 18. The pins 40 are also provided with a head 41 of a circular shape and increased diameter. Each head 41 is made coaxially with respect to the body of the pin 40, in order to guide the rotation of the articulation elements 24 and prevent the respective pin 40 from possibly coming out.

On the surface of the closing element 30, which, during use, faces toward the outside of the closing member 14 (FIG. 3), there are also two hooks 42, for example again made in one piece, which cooperate with corresponding clamping apertures 47 of the clamping plate 44. The hooks 42 extend perpendicularly from the external surface and develop at least partly in a parallel manner to the direction of the axis X.

The closing element 30 also comprises a contrast element 43 (FIGS. 3 and 5) made frontally, which extends upward from the external surface, protruding perpendicularly so as to contrast a lateral edge of the clamping plate 44 in order to maintain it stably in contact with the closing element 30.

The clamping plate 44, made of a metal material of the elastic type, is shaped so as to mate with the "U" shaped profile both of the closing element 30, and the attachment element 18.

The clamping plate 44 is releasably constrained to the closing element 30 when the hooks 42 are inserted in the apertures 47 and the contrast element 43 clamps one edge of the clamping plate 44.

The clamping plate 44 also comprises lateral, recessed curved portions which cooperate with the protuberances 22 of the attachment element 18 in order to stably maintain the closing element 30 in a closed position. The curved portions 45 clamp, in a substantially snap-in manner, the closing element 30 to the attachment element 18.

The closing member 14 also has at least a hole, not shown, with the function of a delivery nozzle, which allows to deliver the washing fluid even toward the "dead" zones of the washing chamber, that is, toward those zones which are not reachable by the washing fluid delivered from the holes of the rotor 10.

The delivery nozzle can be made in the closing element 30 and can be angled according to a direction substantially concordant with the direction of development X of the rotor 10. It is understood that the nozzle can be angled according to a desired angle with respect to a horizontal plane, for example with respect to a horizontal lying plane of the rotor, and/or with respect to a vertical plane. It is also understood that the attachment element 18 can be provided with a delivery nozzle as described above.

The use of the present invention for the maintenance, cleaning and/or sanitizing of the washing rotor 10 as described heretofore is as follows.

During the normal functioning of the rotor 10, the closing elements 14 are stably constrained to the tubular body 12 by means of corresponding attachment screws and the closing portions 30 are disposed in their closed position, stably maintained by the clamping plate.

In order to carry out the maintenance operations, such as cleaning or removing possible residues in the internal cavity of the tubular body 12, it is sufficient to manually release the clamping plate 44 in correspondence to its curved portions 45 and to rotate the closing element 30 around the axis Y, in its open position (FIG. 4), so as to render the internal cavity of the tubular body 12 of the rotor 10 accessible and to introduce a cleaning instrument through the service aperture 17 thus rendered available.

At the end of the operations, it is sufficient to rotate again the closing element 30 into its closed position, clamping it to the attachment element 18 by means of the clamping plate 44.

Therefore, the maintenance operations of the rotor 10 can be carried out easily and quickly, without having to remove the closing member 14 from its relative ends 13.

The invention claimed is:

1. Washing rotor for a washer machine, comprising at least an oblong body having a mainly longitudinal direction of development and having two opposite ends, said oblong body having an internal cavity which develops from one to the other of said opposite ends, so that a washing fluid can pass, wherein at least one of said ends has a service aperture for access into said internal cavity, a closing member being provided for the selective closing of said service aperture, wherein said closing member is formed by at least two elements, of which a first element is removably attached to said at least one end by means of attachment means, and a second element is constrained to the first element and is movable with respect thereto between a first position, or closed position, in which it cooperates with said first element in order to close the service aperture, and a second position, or open position, in which it allows access through the service aperture, said closing member comprising first and second hinging means associated respectively with the first element and with the second element, in order to determine the rotation of the second element with respect to the first element, between the first position or closed position and the second position or open position; and a magnetic element able to cooperate, in use, with a magnetic sensor disposed in a fixed position, said magnetic element being stably positioned in a housing of the closing member.

2. Washing rotor as in claim 1, further comprising first clamping means able to hold in a stable manner the second element in its first position.

3. Washing rotor as in claim 2, wherein the first clamping means are associated with the second element and cooperate mechanically and elastically with the first element.

4. Washing rotor as in claim 2, wherein the first clamping means are associated with the first element and cooperate mechanically and elastically with the second element.

5. Washing rotor as in claim 1, wherein the housing is made in the first element and faces toward the cavity of the oblong body so as to be accessible when the second element is disposed in its second position.

6. Washing rotor as in claim 1, further comprising second clamping means able to hold the magnetic element stably in the housing.

7. Washing rotor as in claim 1, wherein in the first element and/or in the second element at least a delivery nozzle is present, angled and suitable to deliver the washing fluid in a direction concordant to said longitudinal direction of development or at an angle as desired, with respect both to a horizontal plane and/or to a vertical plane.

8. A washer machine comprising a washing rotor as in claim 1.

9. Closing member applicable to at least one end of a washing rotor of a washer machine, for the selective closing of a service aperture of said at least one end by means of which to access an internal cavity of said washing rotor, said closing member comprising a first element configured to be stably constrained to at least said end by means of attachment means, the closing member further comprising a second element, stably connected to the first element and movable with respect thereto between a first position, in which it cooperates with the first element in order to close said service aperture of the at least one end, and a second position, or open position, in which it allows access through the service aperture and in that the closing member comprises first and second hinging means associated respectively with the first element and with the second element, in order to determine the rotation of the second element with respect to the first element, between the first position or closed position and the second position or open position; and a magnetic element able to cooperate, in use, with a magnetic sensor disposed in a fixed position, said magnetic element being stably positioned in a housing of the closing member.

10. Closing member as in claim 9, further comprising first clamping means able to hold the second element stably in its first position.

11. Closing member as in claim 9, wherein the first element and/or the second element comprise at least a delivery nozzle, angled and suitable to deliver the washing fluid in a direction concordant to a longitudinal direction of development of the washing rotor or at an angle as desired, with respect both to a horizontal plane and/or to a vertical plane.

* * * * *